US012180734B2

(12) United States Patent
Tibbetts

(10) Patent No.: US 12,180,734 B2
(45) Date of Patent: Dec. 31, 2024

(54) PVC KEDER WELDED TO VINYL AWNING CANOPY

(71) Applicant: Lippert Components, Inc., Elkhart, IN (US)

(72) Inventor: Scott Tibbetts, Elkhart, IN (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 539 days.

(21) Appl. No.: 17/491,998

(22) Filed: Oct. 1, 2021

(65) Prior Publication Data

US 2022/0106807 A1 Apr. 7, 2022

Related U.S. Application Data

(60) Provisional application No. 63/087,921, filed on Oct. 6, 2020.

(51) Int. Cl.

| | |
|---|---|
| ***E04F 10/02*** | (2006.01) |
| ***E04H 15/64*** | (2006.01) |
| *E04H 15/08* | (2006.01) |

(52) U.S. Cl.

CPC ..... *E04H 15/644* (2013.01); *E04F 10/02* (2013.01); *E04H 15/08* (2013.01)

(58) Field of Classification Search

CPC .... E04F 10/02; E04F 10/0685; E04H 15/644; E04H 15/08

See application file for complete search history.

(56) References Cited

U.S. PATENT DOCUMENTS

| | | | | |
|---|---|---|---|---|
| 3,826,271 | A * | 7/1974 | Sattler | B60P 3/343 135/904 |
| 4,331,169 | A * | 5/1982 | Bonser | E04F 10/0633 156/244.11 |
| 5,437,322 | A * | 8/1995 | Murray | E04F 10/08 160/67 |
| 6,125,905 | A * | 10/2000 | Woodside | E04F 10/0625 160/67 |
| 7,063,096 | B2 | 6/2006 | Stoeckler | |
| 7,604,036 | B2 * | 10/2009 | Thompson | E04F 10/0625 160/67 |
| 7,987,863 | B2 | 8/2011 | Warner | |
| 8,051,867 | B2 | 11/2011 | Hamilton-Jones | |
| 9,038,349 | B2 | 5/2015 | Fox | |
| 9,322,209 | B1 | 4/2016 | Schwind et al. | |
| 9,334,653 | B2 | 5/2016 | Fox | |
| 9,611,662 | B2 | 4/2017 | Bini | |
| 9,850,663 | B1 * | 12/2017 | Thompson | E04F 10/0625 |
| 10,119,295 | B1 | 11/2018 | Ruffin | |
| 10,174,507 | B1 | 1/2019 | Henbid et al. | |

(Continued)

*Primary Examiner* — Johnnie A. Shablack

(74) *Attorney, Agent, or Firm* — NIXON & VANDERHYE P.C.

(57) ABSTRACT

An awning keder includes an awning bead extending along a length of the keder that is sized for insertion into a keder rail, and a connecting panel coupled with the awning bead and extending along the length of the keder. The awning bead and the connecting panel are integrated into a one-piece keder. The one-piece component does not require additional assembly or alteration before welding onto a vinyl canopy, thereby cutting down on production time. The keder is also more durable and less susceptible to expansion or shrinkage resulting from environmental changes.

13 Claims, 4 Drawing Sheets

(56) References Cited

U.S. PATENT DOCUMENTS

| | | | | |
|---|---|---|---|---|
| 10,273,709 | B2 | 4/2019 | Fox | |
| 10,619,376 | B2 | 4/2020 | Hoffmann | |
| 11,028,595 | B2 | 6/2021 | Koch et al. | |
| 2014/0110065 | A1* | 4/2014 | Beland | E04F 10/0625 160/45 |

* cited by examiner

PVC KEDER WELDED TO VINYL AWNING CANOPY

CROSS-REFERENCES TO RELATED APPLICATIONS

This application claims the benefit of U.S. Provisional Patent Application Ser. No. 63/087,921, filed Oct. 6, 2020, the entire content of which is herein incorporated by reference)

STATEMENT REGARDING FEDERALLY SPONSORED RESEARCH OR DEVELOPMENT (NOT APPLICABLE)

BACKGROUND

The invention relates to awnings attachable to recreational vehicles and other structures and, more particularly, to a one-piece keder connectable directly to an awning canopy.

Awning keder is typically formed with a rubber, plastic, polycord or other material bead, rolling fabric over the bead, and either sewing or welding the fabric into place. FIG. 1 shows an exemplary application of an existing keder assembly. Keder is typically attached to fabric to create a continuous waterproof connection between fabric and frame. Keder is used in a variety of applications including both permanent and semi-permanent tents and structures, banners, building wraps, façades, awnings, curtains and marine products to name a few.

Sometimes, the fabric over the bead is provided with an adhesive on the inner surface for assisting the bonding and adhesion during welding. The outer surface of the fabric may have a texture or weave to reduce friction or resistance as the keder is installed into a rail or when a light extrusion is installed into the keder.

The procedures required to manufacture the keder can take significant production time. The fabric material must be held in place while it is sewn or welded to itself around the bead. Moreover, durability is a concern in some environments, and depending on the application, environmental changes can cause the fabric to shrink or expand, resulting in unpredictable structural connections.

SUMMARY

The awning keder of the described embodiments overcomes the drawbacks of existing keder products. The keder is not wrapped in fabric, but is rather a one-piece plastic product, preferably of polyvinyl chloride (PVC) material, including at least an awning bead and an integrated connecting panel. The one-piece component does not require additional assembly or alteration before welding to the awning canopy. The described keder cuts down on production time, is more durable, and is stable over environmental changes and will not shrink or expand. The use of PVC in some embodiments is rigid and threads nicely and will not shrink to remain captured in the track or expand to damage the track.

In one embodiment, the awning keder has the awning bead for sliding into a rail of the awning roller tube to attach the canopy to the awning roller. In some embodiments, the awning keder may include a second bead for receiving a light strip or the like for illuminating behind and under the awning roll.

In an exemplary embodiment, an awning keder includes an awning bead extending along a length of the keder that is sized for insertion into a keder rail, and a connecting panel coupled with the awning bead and extending along the length of the keder. The awning bead and the connecting panel are integrated into a one-piece keder.

The awning bead and the connecting panel may be formed of polyvinyl chloride (PVC). The awning bead may be substantially cylindrical in cross-section. The connecting panel may extend from a center of the awning bead. The awning bead and the connecting panel may be joined at a proximal end of the connecting panel.

In some embodiments, the awning keder includes an auxiliary bead spaced from the awning bead. The auxiliary bead may be integrated with the awning bead and the connecting panel as part of the one-piece keder. The awning bead and the connecting panel may be joined at a proximal end of the connecting panel, and the auxiliary bead and the connecting panel may be joined at a distal end of the connecting panel.

In another exemplary embodiment, an awning includes a vinyl canopy and the awning keder of the described embodiments. The vinyl canopy is secured to the connecting panel, for example, by being welded to the connecting panel.

In yet another exemplary embodiment, a method of assembling an awning includes the steps of (a) providing an awning keder with an awning bead extending along a length of the keder and a connecting panel coupled with the awning bead and extending along the length of the keder, wherein the awning bead and the connecting panel are integrated into a one-piece keder; and (b) securing a vinyl canopy directly to the connecting panel.

BRIEF DESCRIPTION OF THE DRAWINGS

These and other aspects and advantages will be described in detail with reference to the accompanying drawings, in which.

DETAILED DESCRIPTION

Figure 1:
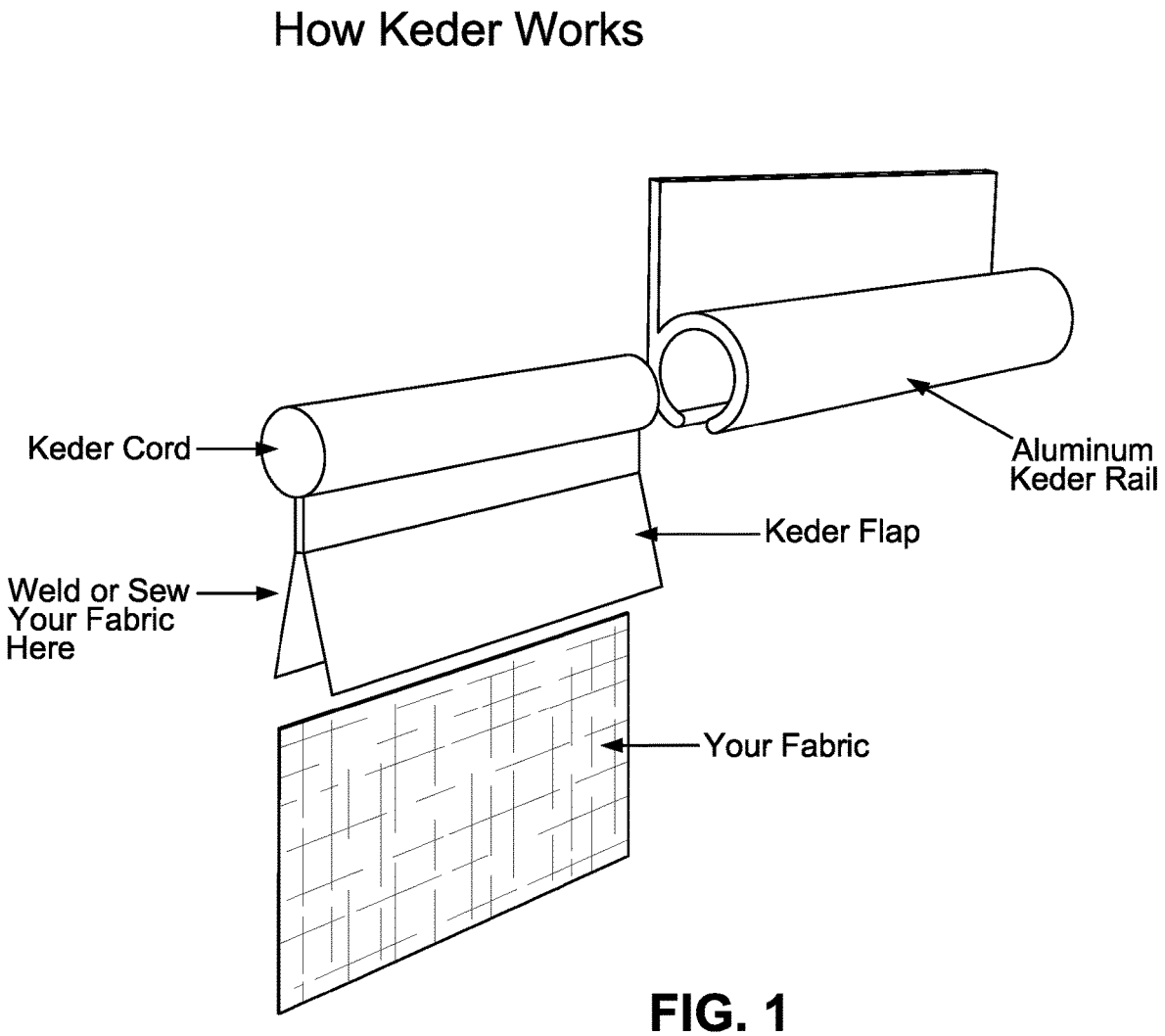
FIG. 1 (PRIOR ART)
FIG. 1 shows a prior art keder assembly.
Figure 2:
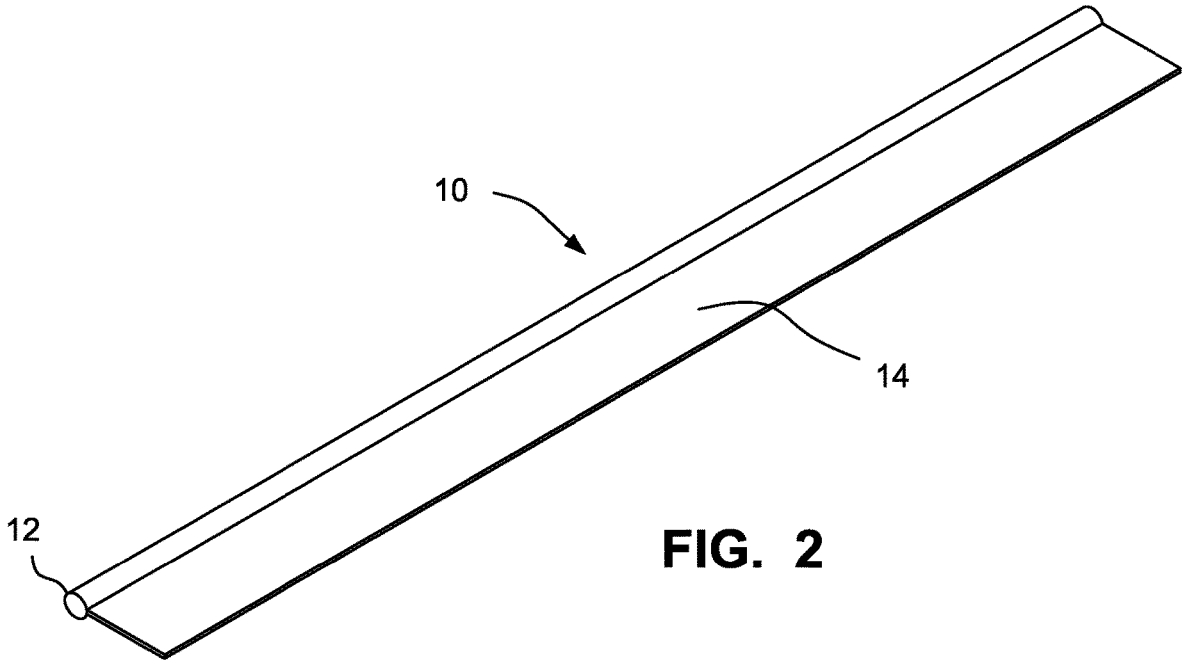
FIG. 2 is a perspective view of the awning keder.
Figure 3:
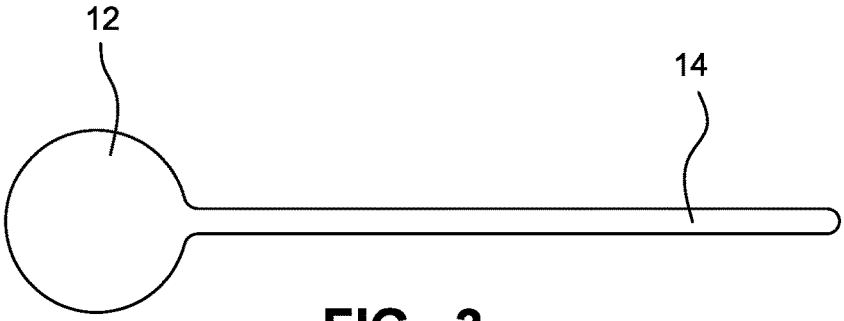
FIG. 3 is a side view of the awning keder.
Figure 4:
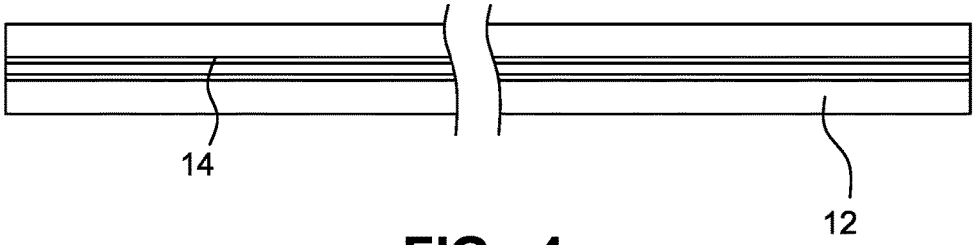
FIG. 4 is an end view of the awning keder.

With reference to FIGS. 2-4, the awning keder 10 of the described embodiments includes an awning bead 12 extending along a length of the keder 10. The awning bead 12 is sized for insertion into a typical keder rail (see, e.g., FIG. 1).

The awning keder 10 also includes a connecting panel 14 coupled with the awning bead 12 and extending along the length of the keder 10. The awning bead 12 and the connecting panel 14 are integrated into a one-piece keder.

With particular reference to FIG. 3, the awning bead 12 may be substantially cylindrical in cross-section, and the connecting panel 14 may extend from a center of the awning bead 12. The awning bead 12 and the connecting panel 14 are joined at a proximal end of the connecting panel 14.

In some embodiments, the one-piece keder included the awning bead 12 and the connecting panel 14 is formed of polyvinyl chloride (PVC). The one-piece keder may be formed by extrusion or may be molded.

A canopy 16 (FIGS. 5-7) such as a vinyl canopy or other suitable material canopy can be welded directly to the awning keder 10 using a known welding press roller. The heating element set point (which is not the temperature at the actual contact weld) may be between 700-730° C. at a welding speed of 50-65 ft/min. The press roller pressure is defined by factory air line pressure and weld cylinder size, which is constant.

Figure 5:
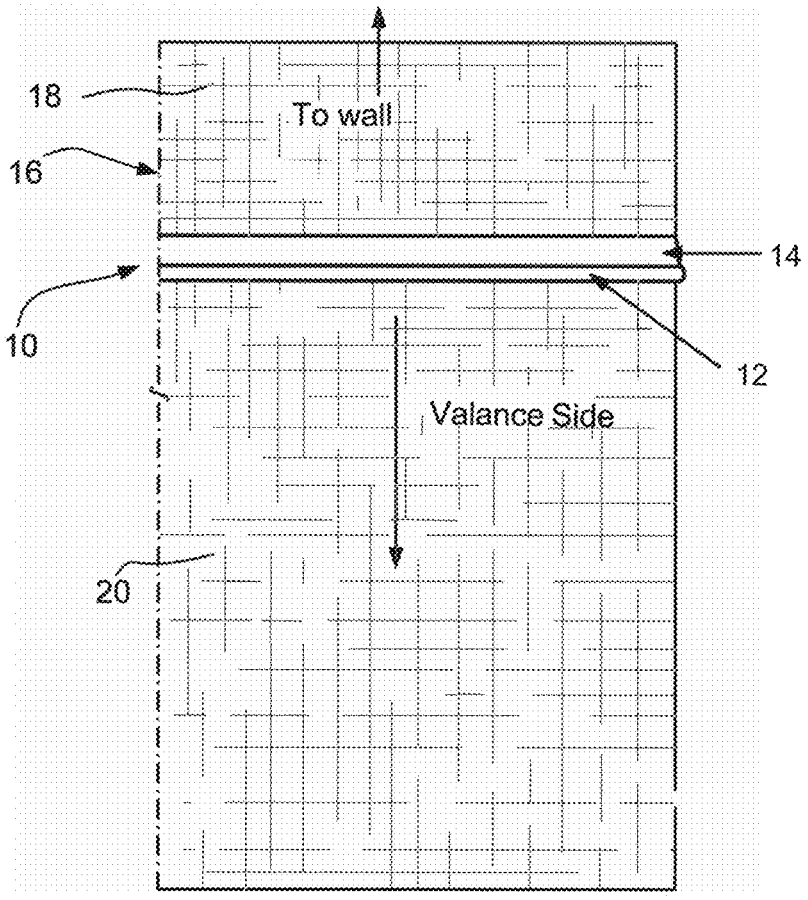
FIG. 5 shows an exemplary application of the awning keder.

Since the awning keder 10 of the described embodiments does not include a bead wrapped in fabric, the exposed PVC material is directly attached to another object, such as the wall, the awning roll, etc. The one-piece structure provides the added benefit of being able to weld the awning keder anywhere on the fabric canopy and not necessarily near an edge of the fabric. FIG. 5 shows an exemplary application with the awning keder 10 secured to the canopy 16 with a wall side 18 on one side of the awning keder 10 and a valance side 20 on an opposite side of the awning keder 10. The awning keder is secured in a middle of the canopy 16.

Figure 6:
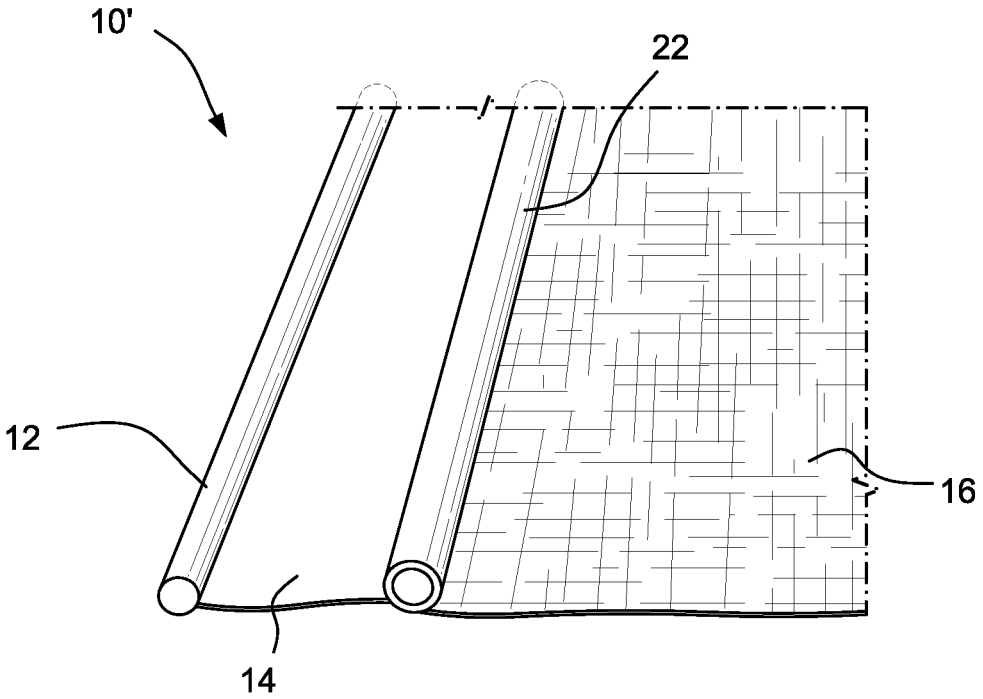
FIGS. 6 and 7 show the awning keder including an auxiliary bead.
Figure 7:
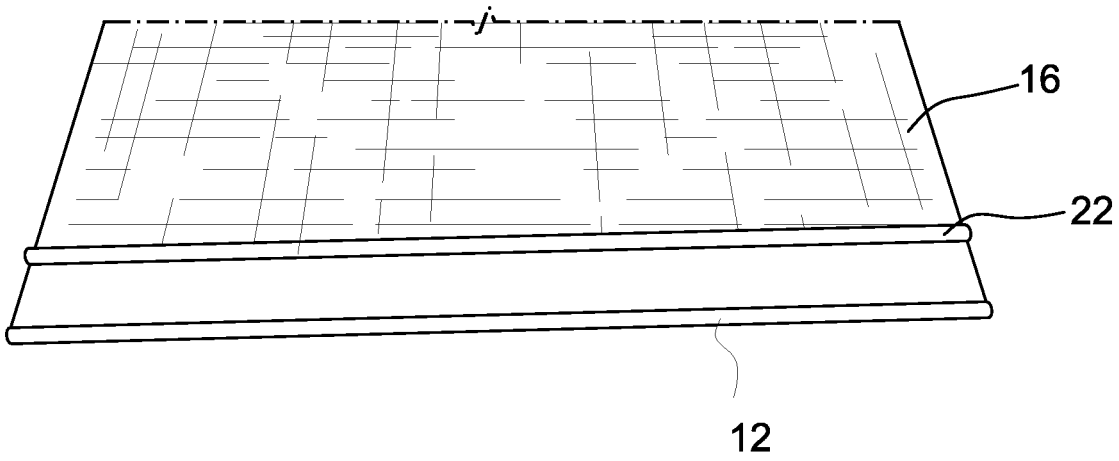

FIGS. 6 and 7 show an alternative embodiment where the awning keder 10' includes an auxiliary bead 22 spaced from the awning bead 12. The auxiliary bead 22 is integrated with the awning bead 12 and the connecting panel 14 as part of the one-piece keder. In some embodiments, the auxiliary bead 22 may be configured for receiving the light attachment such as an LED light strip for illuminating behind and under the awning roll. In the exemplary embodiment shown in FIGS. 6 and 7, the auxiliary bead 22 is joined to the connecting panel 14 at an end opposite from the awning bead 12 (i.e., a distal end of the connecting panel 14).

The awning bead 12 is configured to be slid into a rail of the awning roller tube to attach the canopy 16 to an awning roller. In the embodiment with the awning bead 12 and the auxiliary bead 22, the awning bead is configured for attaching to a mounting rail attached to the vehicle, and the auxiliary bead is intended for receiving an LED light strip or the like for illuminating behind and under the awning roll.

The one-piece awning keder does not require additional assembly or alteration before welding onto the final canopy. The awning keder advantageously cuts down on production time, is more durable, and is stable over environmental changes such that the keder will not shrink or expand. The use of PVC material provides for a rigid keder that threads nicely and will remain captured in the track and similarly will not expand to damage the track. The awning keder of the described embodiments does not need fabric or additional treatment for protection.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. An awning keder comprising:

an awning bead extending along a length of the keder, the awning bead being sized for insertion into a keder rail;

an auxiliary bead spaced from the awning bead; and a connecting panel coupled between the awning bead and the auxiliary bead and extending along the length of the keder, wherein the awning bead, the auxiliary bead, and the connecting panel are integrated into a one-piece keder, and wherein a plane of the connecting panel directly extending from the auxiliary bead is offset from a center of the auxiliary bead.

2. The awning keder according claim 1, wherein the awning bead, the auxiliary bead and the connecting panel are formed of polyvinyl chloride (PVC).

3. The awning keder according claim 1, wherein the awning bead is substantially cylindrical in cross-section.

4. The awning keder according claim 1, wherein the connecting panel extends from a center of the awning bead.

5. The awning keder according claim 1, wherein the awning bead and the connecting panel are joined at a proximal end of the connecting panel.

6. The awning keder according claim 1, wherein the awning bead and the connecting panel are joined at a proximal end of the connecting panel, and wherein the auxiliary bead and the connecting panel are joined at a distal end of the connecting panel.

7. An awning comprising:

a vinyl canopy; and an awning keder including:

an awning bead extending along a length of the keder, the awning bead being sized for insertion into a keder rail, an auxiliary bead spaced from the awning bead; and a connecting panel coupled between the awning bead and the auxiliary bead and extending along the length of the keder, wherein the awning bead, the auxiliary bead, and the connecting panel are integrated into a one-piece keder, and wherein a plane of the connecting panel directly extending from the auxiliary bead is offset from a center of the auxiliary bead, wherein the vinyl canopy is secured to the connecting panel.

8. The awning according to claim 7, wherein the vinyl canopy is welded to the connecting panel.

9. A method of assembling an awning comprising:

(a) providing an awning keder with an awning bead extending along a length of the keder, an auxiliary bead spaced from the awning bead, and a connecting panel coupled between the awning bead and the auxiliary bead and extending along the length of the keder, wherein the awning bead, the auxiliary bead, and the connecting panel are integrated into a one-piece keder, and wherein a plane of the connecting panel directly extending from the auxiliary bead is offset from a center of the auxiliary bead; and (b) securing a vinyl canopy directly to the connecting panel.

10. The method according to claim 9, wherein step (a) comprises extruding the one-piece keder from PVC.

11. The method according to claim 9, wherein step (b) comprises welding the vinyl canopy to the connecting panel.

12. The method according to claim 9, further comprising connecting a light attachment to the auxiliary bead.

13. The method according to claim 9, further comprising inserting the awning bead into a rail of an awning roller tube or into a vehicle mounting rail.

* * * * *